US010081412B2

(12) United States Patent
Lundin et al.

(10) Patent No.: US 10,081,412 B2
(45) Date of Patent: Sep. 25, 2018

(54) FLOATING VESSEL WITH TANK TROUGH DECK

(71) Applicants: Henning Lundin, Gothenburg (SE); David Christer André, Gothenburg (SE)

(72) Inventors: Henning Lundin, Gothenburg (SE); David Christer André, Gothenburg (SE)

(73) Assignee: GVA Consultants AB, Göteborg (SE)

( * ) Notice: Subject to any disclaimer, the term of this patent is extended or adjusted under 35 U.S.C. 154(b) by 197 days.

(21) Appl. No.: 14/099,269

(22) Filed: Dec. 6, 2013

(65) Prior Publication Data

US 2015/0158558 A1 Jun. 11, 2015

(51) Int. Cl.

| | |
|---|---|
| ***B63B 25/16*** | (2006.01) |
| ***B63B 25/08*** | (2006.01) |
| ***B63B 25/12*** | (2006.01) |
| ***F17C 13/08*** | (2006.01) |
| ***B63B 1/10*** | (2006.01) |
| ***B63B 17/00*** | (2006.01) |

(52) U.S. Cl.

CPC ..... *B63B 25/16* (2013.01); *B63B 1/107* (2013.01); *B63B 17/0036* (2013.01); *B63B 25/082* (2013.01); *B63B 25/12* (2013.01); *F17C 13/082* (2013.01); *B63B 2025/087* (2013.01)

(58) Field of Classification Search

CPC ... B63B 25/08; B63B 2025/087; B63B 25/12; B63B 25/14; B63B 25/16; B63B 35/44; B63B 35/4413; B63B 2035/448; B63B 2035/4486; B63B 25/082; F17C 13/082

USPC ..... 114/74 R, 74 T, 74 A, 256, 264, 265

See application file for complete search history.

(56) References Cited

U.S. PATENT DOCUMENTS

| | | | | |
|---|---|---|---|---|
| 3,113,544 | A * | 12/1963 | Malcolmson | B63B 25/10 114/74 R |
| 3,507,238 | A * | 4/1970 | Chow | B63B 35/4413 114/256 |
| 4,004,535 | A * | 1/1977 | Oiern | B63B 11/02 114/74 A |
| 4,090,460 | A | 5/1978 | Nishimaki et al. | |
| 5,361,931 | A * | 11/1994 | VanLandingham | B65D 90/24 141/86 |
| 7,757,621 | B2 * | 7/2010 | Breivik | B63B 25/14 114/74 A |
| 8,317,428 | B2 * | 11/2012 | Liberg | B63B 13/00 210/170.11 |
| 8,499,569 | B2 * | 8/2013 | Van Tassel | B63B 25/16 62/48.2 |
| 9,132,892 | B2 * | 9/2015 | Lundin | B63B 25/12 |
| 2005/0217554 | A1 | 10/2005 | Steen | |

(Continued)

FOREIGN PATENT DOCUMENTS

| | | | | |
|---|---|---|---|---|
| EP | 0611692 | A1 * | 8/1994 | B63B 25/082 |
| FR | 2731415 | A1 * | 9/1996 | B63B 11/04 |

(Continued)

*Primary Examiner* — Ajay Vasudeva

(74) *Attorney, Agent, or Firm* — Gary Machetta

(57) ABSTRACT

Herein a floating vessel is disclosed. The floating vessel comprises a deck member and a tank for liquefied hydrocarbon gas such as LNG. The tank extends through the deck member, and the tank is supported by the deck member, suspended at less than ⅓ of a total height of the tank, seen from the top of the tank.

20 Claims, 3 Drawing Sheets

(56) References Cited

U.S. PATENT DOCUMENTS

| | | | | |
|---|---|---|---|---|
| 2007/0062430 | A1 | 3/2007 | Noble et al. | |
| 2009/0293506 | A1* | 12/2009 | Ryu | F17C 3/025 62/53.1 |
| 2010/0139547 | A1* | 6/2010 | Morimoto | B63B 27/24 114/74 R |
| 2010/0206213 | A1 | 8/2010 | Kullander et al. | |
| 2011/0041753 | A1 | 2/2011 | Willen et al. | |
| 2014/0369765 | A1* | 12/2014 | Fargier | B63B 25/14 405/224 |

FOREIGN PATENT DOCUMENTS

| | | | | |
|---|---|---|---|---|
| GB | 2310634 | A * | 9/1997 | B63B 35/4413 |
| WO | 2010/028240 | A2 | 3/2010 | |
| WO | WO 2011089108 | A1 * | 7/2011 | B63B 27/24 |
| WO | 2012/016295 | A1 | 2/2012 | |

* cited by examiner

FLOATING VESSEL WITH TANK TROUGH DECK

TECHNICAL FIELD

Embodiments disclosed herein relate to a floating vessel.

BACKGROUND

Some floating vessels comprise one or more tanks for storing a liquefied hydrocarbon gas, such as LNG (Liquefied Natural Gas) or LPG (Liquefied Petroleum Gas).

WO 2010/028240 and US 2007/062430 disclose a liquid containment system for a seafaring vessel. The liquid containment system includes a tank having an at least partially non-planar upper portion. The upper portion of the tank contains a substantial portion of the liquid therein and reduces the free surface area associated with the liquid. The upper portion of the tank extends above the horizontal deck of the vessel, but still allows sufficient deck space for supporting various required equipment. In one embodiment, the liquid containment system is a membrane tank designed to receive and hold liquefied natural gas ("LNG").

U.S. Pat. No. 4,090,460 discloses a spherical tank supporting system for low temperature liquefied gas storage tank carrying vessel. A support deck extends on a level above the bottom of a hold of a vessel carrying low temperature liquefied storage spherical tanks, from bulkheads of the hull so as to surround such spherical tanks, while a horizontal support ring projects from the outer surface of the spherical tank and is supported on the support deck through support chocks. The circular inner peripheral edge of the support deck is supported by brackets erected on the bottom plate of the hold and radially extending toward the bulkheads or by columns erected on the bottom plate of the hold. The spherical tank is of a self-supporting type (as opposed to a tank of the membrane type).

WO 2012/016295 discloses a gaseous fuel powered marine vessel. The vessel comprises at least two hulls and a portion disposed between the two hulls, a propulsion system operable using a gaseous fuel, and a storage means for containing a supply of gaseous fuel for a propulsion system, the storage means being accommodated in the portion between the two hulls. The storage means is placed in the marine vessel a significant distance aft from the bow and close to the vessel bottom.

US 2011/041753 discloses a semi-submersible offshore platform body for supporting drilling, storing, treatment or production of hydrocarbons at sea. The platform body has a cross section with a centre point in a first plane, and is defined by a side wall formed by at least one hollow side wall section. Inside the side wall section there are arranged storage tanks for storing e.g. LNG.

US 2009/293506 discloses a semi-submersible offshore structure having storage tanks for liquefied gas, which is constructed so as to improve workability in marine offloading of the liquefied gas stored in the storage tanks while reducing an influence of sloshing. The offshore structure is anchored at sea. The offshore structure includes storage tanks for storing liquefied gas, a plurality of columns partially submerged under the sea level, and an upper deck located on the plurality of columns to connect the columns to each other. The storage tanks are arranged in the columns.

Liquefied hydrocarbon gas is stored at low temperatures, e.g. LNG is handled at a temperature of −163 degrees Celsius. Thus, a tank for storing liquefied hydrocarbon gas is subjected to temperature changes as an empty tank, having the temperature of a surrounding environment, is filled with liquefied hydrocarbon gas. Due to the temperature changes a length of the tank will change, the tank contracting when filled with the cold liquefied gas.

SUMMARY

It is an object to provide an alternative arrangement of a tank for liquefied hydrocarbon gas in a floating vessel.

According to an aspect, this is achieved by a floating vessel comprising a deck member and a tank for liquefied hydrocarbon gas such as LNG. During use of the floating vessel the deck member comprises an upper side facing upwardly, a lower side facing downwardly, and the tank comprises a top and a bottom. The tank extends through the deck member. The tank is supported by the deck member suspended at less than ⅓ of a total height of the tank from the top of the tank.

Since the tank is supported by the deck member and the tank is suspended at less than ⅓ of a total height of the tank from the top of the tank, changes in length of the tank will mainly affect the ⅔ or more of the tank below the suspension at the deck member. Accordingly, pipe connections to the tank connected at a top end portion of the tank will be less affected by the length changes of the tank than in the prior art arrangements where the tank is supported at its middle, e.g. as illustrated in U.S. Pat. No. 4,090,460. Moreover, the tank being supported by the deck member provides a convenient arrangement of the tank in the floating vessel.

The floating vessel may for instance be a ship or a semi-submersible offshore platform. The deck member may be an upper deck of the floating vessel or one of lower level decks of the floating vessel. Suitably, the deck member may have a self-supporting structure and is supported by the hull and/or bulkheads of the vessel, i.e. no specific enforcements may be required for supporting the deck member in order to support the tank, i.e. contrary to the supporting system disclosed in U.S. Pat. No. 490,460. The tank is mainly foreseen to be a liquefied gas fuel tank for a gas consumer aboard the floating vessel. However, the tank may alternatively be a tank for storing liquefied gas aboard a production vessel or a transport vessel. Substantially the entire weight of the tank may be supported by the deck member.

According to embodiments, the deck member may form a lower deck of the floating vessel, above which lower deck at least one higher level deck extends. Since the tank extends through the deck member, the tank is protected by the higher level deck/s from heavy falling objects. The term lower deck entails any deck arranged below a deck and thus, encompasses other decks than the lowest deck of a floating vessel.

According to embodiments, the floating vessel may comprise at least one pipe connected to the tank above the upper side of the deck member. In this manner the at least one pipe is affected less by length changes of the tank than if the at least one pipe would have been connected to the tank below the deck member. The at least one pipe may be a pipe for conducting liquefied gas or gas to and/or from the tank. Moreover, if pipe connections are entirely omitted below the deck member, the area below the deck member may be classified as a hazardous area with a lower risk zone classification than if pipe connections were present.

According to embodiments, the upper side of the deck member adjacent to the tank may be contiguous with an ambient environment of the floating vessel. In this manner the area where pipes are connected to the tank may be naturally ventilated. Thus, the hazardous area classification may be positively affected. An alternative would be to provide a closed space around the upper side of the deck member adjacent to the tank, and to provide forced ventilation of this space.

According to embodiments, the floating vessel may comprise a dedicated tank compartment for the tank underneath the deck member. In this manner the tank may be sealed off from other spaces and areas below the deck member.

According to embodiments, the floating vessel may comprise a guide arrangement arranged between the compartment and a bottom end portion of tank. In this manner the tank may be stabilised during rough sea.

According to embodiments, the tank may comprise at least one projection, the at least one projection being arranged to transfer a weight of the tank to the deck member. In this manner the tank may be suspended by the projection from the deck member. The at least one projection may comprise for instance, a flange or rim extending at least partially around the tank. Alternatively, the at least one projection may comprise a number of singular projections extending radially outwardly from the tank.

According to embodiments, the floating vessel may comprise a seal arranged between the tank and the upper side of the deck member. In this manner water may be prevented from leaking from the upper side of the deck member along the tank to below the deck member. Any type of seal achieving this may be used, such as a sheet metal skirt welded to the tank and the deck member, or an elastic seal arranged between a flange of the tank and the deck member.

According to embodiments, the tank may comprise at least one protuberance extending underneath the deck member. In this manner the tank may be prevented from floating up through the deck member in case a compartment containing the tank below the deck member should be filled with water. Similarly, the tank may be maintained in its position in relation to the deck member, should the floating vessel capsize. The at least one protuberance may comprise for instance, a flange or rim extending at least partially around the tank. Alternatively, the at least one protuberance may comprise a number of singular protuberances extending radially outwardly from the tank.

According to embodiments, the tank may comprise a self-supporting tank structure. In this manner the tank may not require any external tank-surrounding structure to permit the tank to store liquefied hydrocarbon gas. The self-supporting tank structure may comprise inner and outer tank walls and insulation layer/s.

According to embodiments, the tank may be elongated and may have a longitudinal axis. The longitudinal axis may be arranged substantially vertically in the floating vessel. It is to be understood that an elongated tank is longer than it is wide. Arranging the longitudinal axis vertically may ensure that length changes of the tank take place in the vertical direction.

According to embodiments, the floating vessel may comprising an engine and/or an other gas consumer, wherein the tank may be a dedicated fuel tank for the engine and/or the other gas consumer. The engine may be an engine for directly or indirectly propelling the floating vessel and/or an engine for driving an electric generator. Examples of other gas consumers are for instance an incinerator, a boiler, and a fuel cell. A dedicated fuel tank is a tank, the entire contents of which are used as a fuel for the engine and/or the other gas consumer.

According to embodiments, the floating vessel may be a semi-submersible offshore platform comprising one or more submersible pontoons, at least a first and a second column, and a deck structure adapted to be arranged above a water surface and comprising the deck member. The first and second columns may be connected to the one or more submersible pontoons and the deck structure. According to some embodiments the first and second columns may support the deck structure above the water surface. According to some embodiments, the semi-submersible offshore platform may be a heavy lift unit, a drilling unit, an accommodation unit, a production unit, or a well intervention unit.

According to embodiments, the tank may be arranged in the first column.

According to embodiments, the first column may comprise at least a first portion and a second portion, the first portion being arranged closer to the second column than the second portion. The compartment may be arranged in the first portion. In this manner the tank may be arranged towards a middle portion of the semi-submersible offshore platform and accordingly, the tank is protected against damage emanating from a sea side direction of the semi-submersible offshore platform.

According to embodiments, the floating vessel may comprise a further tank for liquefied gas, the further tank being arranged in the second column.

According to embodiments, the floating vessel may comprise a tunnel extending through the deck structure. The tunnel may be arranged in open connection to an ambient environment of the floating vessel. Pipes leading to and/or from the tank and the further tank may extend through the tunnel. In this manner pipes for liquefied gas or gas may be arranged in a ventilated environment. Moreover, through the tunnel the tank and the further tank may be reached from both ends of the tunnel.

According to embodiments, a pipe leading from the tank to the engine and/or the other gas consumer may extend through the tunnel.

According to embodiments, the tunnel may comprise an inclined surface arranged beneath pipes in the tunnel. The inclined surface may be inclined downwardly towards an end of tunnel.

Further features and advantages will become apparent when studying the appended claims and the following detailed description.

BRIEF DESCRIPTION OF THE DRAWINGS

Various aspects of embodiments, including their particular features and advantages, will be readily understood from example embodiments discussed in the following detailed description and accompanying drawings, in which.

DETAILED DESCRIPTION

Aspects of example embodiments will now be described more fully. Like numbers refer to like elements throughout. Well-known functions or constructions will not necessarily be described in detail for brevity and/or clarity.

Figure 1:
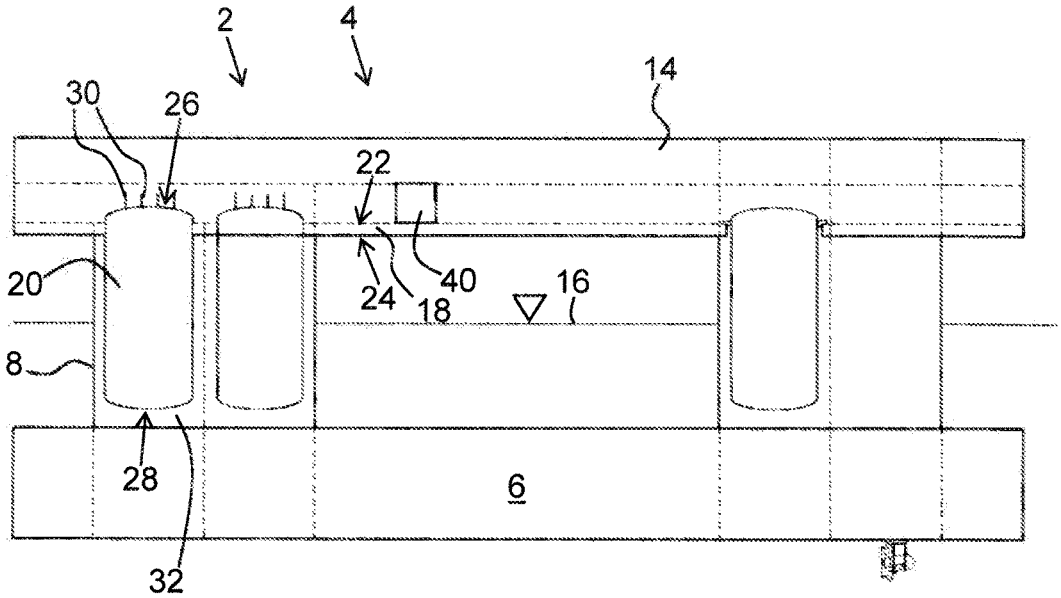
FIGS. 1 and 2 schematically illustrate a side view cross section and a top view cross section of a floating vessel according to embodiments, FIG. 3 schematically illustrates a partial side view cross section of a floating vessel according to embodiments, and FIG. 4 schematic illustrates a front view cross section of embodiments of a floating vessel in the form of a semi-submersible offshore platform.
Figure 2:
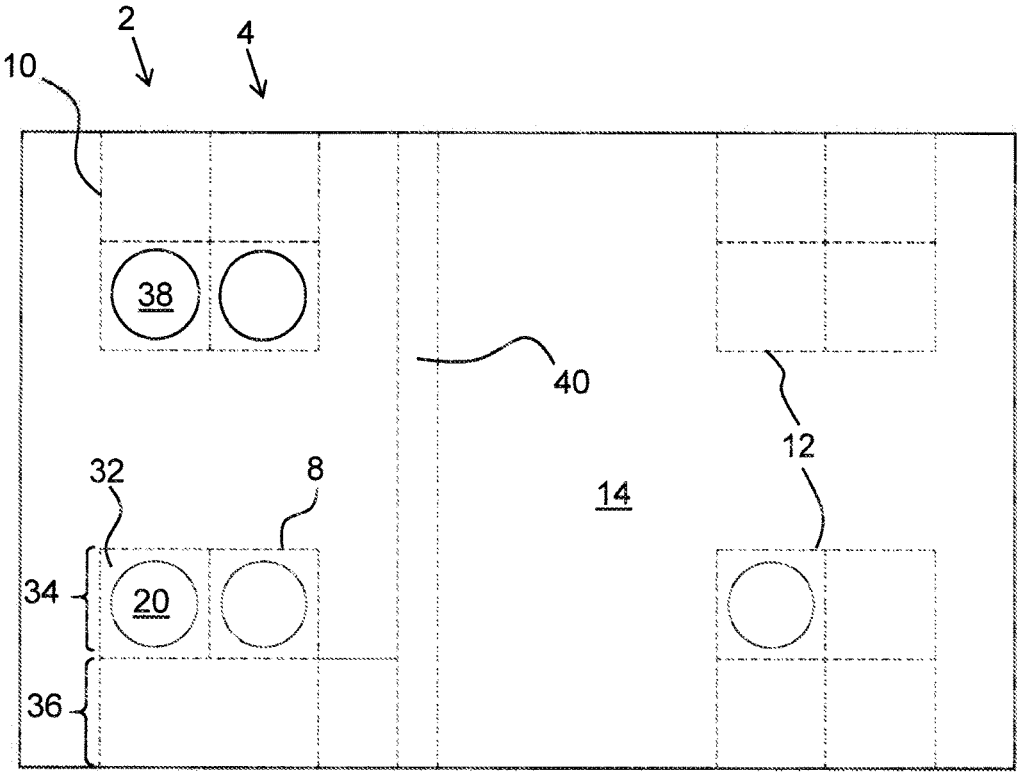

FIGS. 1 and 2 schematically illustrate a side view cross section and a top view cross section of a floating vessel 2 according to embodiments. The floating vessel 2 is a semi-submersible offshore platform 4 comprising one or more submersible pontoons 6, a first column 8, a second column 10, and two more columns 12. The semi-submersible offshore platform 4 further comprises a deck structure 14 adapted to be arranged above a water surface 16. Depending on the use of the semi-submersible offshore platform 4, various equipment may be arranged atop the upper deck of the deck structure 14. The columns 8, 10, 12 are connected to the one or more submersible pontoons 6. The columns 8, 10, 12 are connected to, and support, the deck structure 14 above the water surface 16. The deck structure 14 comprises a deck member 18. The deck member 18 may be an ordinary deck, or a deck unit comprising one or more sealed compartments which may form a floating aid in case the semi-submersible offshore platform 4 should it capsize.

The floating vessels 2 comprises a tank 20 for liquefied hydrocarbon gas. During use of the floating vessel 2, i.e. as illustrated in FIG. 1, the deck member 18 comprises an upper side 22 facing upwardly, a lower side 24 facing downwardly, and the tank 20 comprises a top 26 and a bottom 28. The tank 20 extends through the deck member 18. The tank 20 is supported by the deck member 18 and the tank 20 is suspended at less than ⅓ of a total height of the tank 20 from the top 26 of the tank 20.

At least one pipe 30 is connected to the tank 20 above the upper side 22 of the deck member 18. The at least one pipe 30 may be a pipe for conducting liquefied gas or gas to, and/or from, the tank 20. Pipe connections to, and/or from, the tank 20 are entirely omitted below the deck member 18. The tank 20 is arranged in a dedicated tank compartment 32 underneath the deck member 18. The deck member 18 forms an upper limitation of the tank compartment 32. The tank 20 comprise a self-supporting tank structure. The tank 20 may for instance be designed to withstand an internal pressure of 10 bar. The tank 20 is elongated and has a longitudinal axis. The longitudinal axis is arranged substantially vertically in the floating vessel.

The tank 20 is arranged in the first column 8. The first column 8 comprises at least a first portion 34 and a second portion 36. The first portion 34 is arranged closer to the second column 10 than the second portion 36. The rank 20 and the compartment 32 are arranged in the first portion 34. Thus, the tank 20 is arranged towards a middle portion of the semi-submersible offshore platform. Accordingly, should the first column 8 be damaged from a sea side direction, it is the second portion 36 without the tank 20 that takes the main impact.

The floating vessel 2 comprises a further tank 38 for liquefied gas. The further tank 38 is arranged in the second column 10. In these embodiments additional tanks are provided in the columns 8, 10, 12, in total five tanks are provided. Less or more tanks may be provided in alternative embodiments.

The floating vessel 2 comprises a tunnel 40 extending through the deck structure 14. The tunnel 40 is arranged in open connection to an ambient environment of the floating vessel 2. Pipes (not shown) leading to and/or from the tank 20 and the further tank 38 extend through the tunnel 40.

Figure 3:
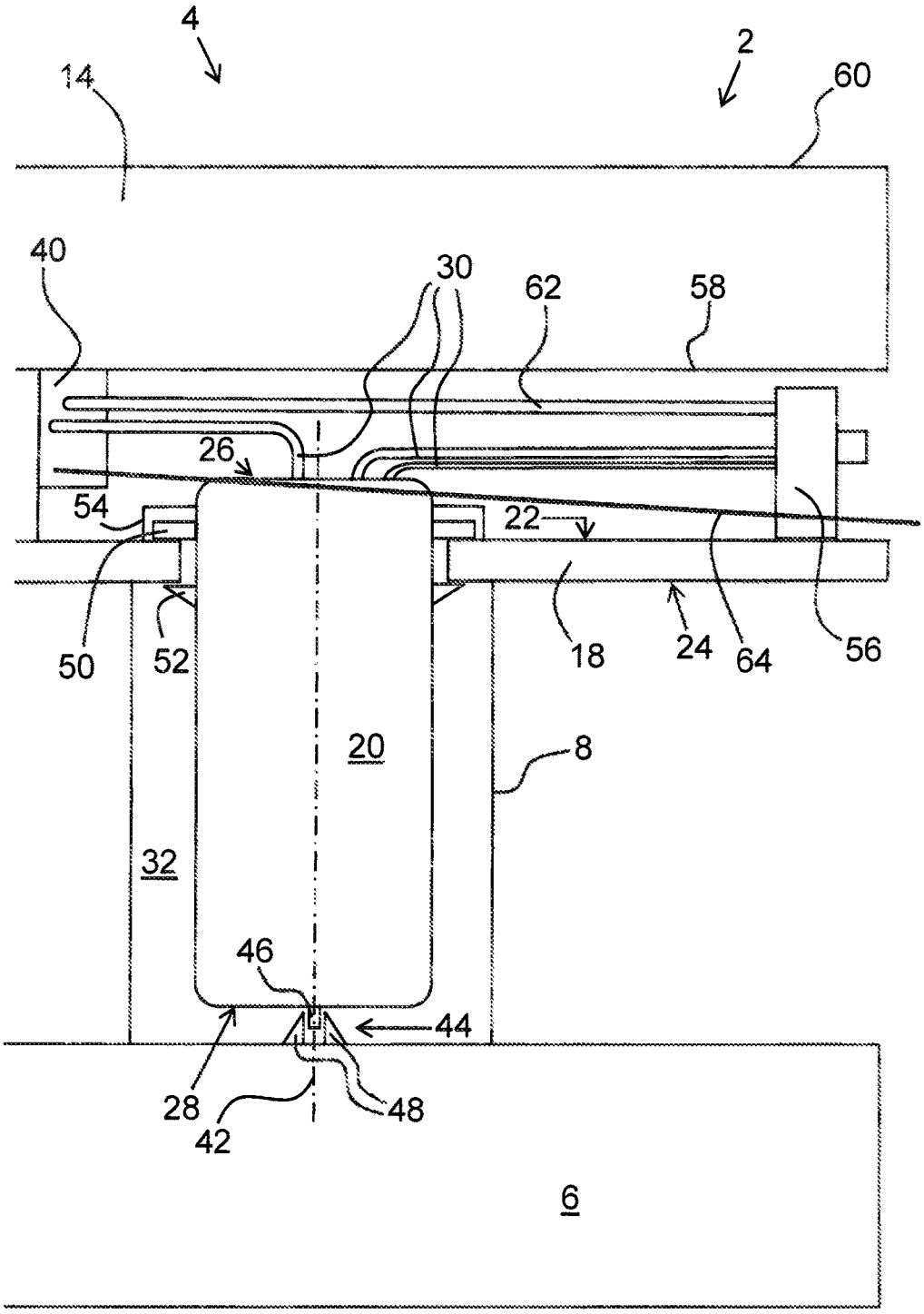

FIG. 3 schematically illustrates a partial side view cross section of a floating vessel 2 according to embodiments. The floating vessel 2 comprises a deck member 18 and a tank 20 for liquefied hydrocarbon gas. During use of the floating vessel 2, as illustrated in FIG. 3, the deck member 18 comprises an upper side 22 facing upwardly, and a lower side 24 facing downwardly. In the same position of the floating vessel 2 the tank 20 comprises a top 26 and a bottom 28. The tank 20 extends through the deck member 18. The deck member 18 may a deck unit comprising one or more sealed compartments. Alternatively, the deck member 18 may be an ordinary deck. The tank 20 is supported by the deck member 18. Substantially the entire weight of the tank 20 is supported by the deck member 18. The tank 20 is suspended at less than ⅓ of a total height of the tank 20, seen from the top 26 of the tank 20.

The tank 20 may be suspended at less than ⅕ of a total height of the tank 20, seen from the top 26 of the tank 20. The tank 20 may be suspended at approximately 1/10 of a total height of the tank 20, seen from the top 26 of the tank 20. Mentioned purely as an example, the tank 20 may have a total height of approximately 20 meters and the tank 20 may be suspended at approximately 2 meters from the top 26 of the tank 20.

The tank 20 comprises a self-supporting tank structure. The tank 20 is elongated and has a longitudinal axis 42. The longitudinal axis 42 is arranged substantially vertically in the floating vessel 2. The tank 20 is arranged in a dedicated tank compartment 32 underneath the deck member 18. The dedicated tank compartment 32 is delimited by sidewalls, a floor, and the deck member 18. A guide arrangement 44 is arranged between the compartment 32 and a bottom end portion of tank 20. The gate arrangement 44 may be arranged at the bottom 28 of the tank 20, as illustrated, or at a side of the tank 20 at the bottom end portion of the tank 20.

In these embodiments, the guide arrangement 44 comprises a protruding member 46 extending in parallel with the longitudinal axis 42 and being connected to the bottom 28 of the tank 20, and a recess forming arrangement 48 connected to the floor of the compartment 32. The protruding member 46 extends into a recess of the recess forming arrangement 48. Thus, the tank 20 is stabilised in lateral directions at its bottom end portion. The protruding member 46 has a length such that it extends into the recess of the recess forming arrangement 48, also when the tank 20 is in its shortest state, i.e. when filled with liquefied hydrocarbon gas. The tank 20 comprises at least one projection 50. The at least one projection 50 is arranged to transfer the weight of the tank 20 to the deck member 18. In this manner the tank 20 is suspended by the projection 50 from the deck member 18. The tank 20 comprises at least one protuberance 52 extending underneath the deck member 18. A seal is arranged between the tank 20 and the upper side 22 of the deck member 18. In these embodiments the seal comprises a sheet metal skirt 54 welded to the tank 20 and the deck member 18.

The floating vessel 2 comprises at least one pipe 30 connected to the tank 20 above the upper side 22 of the deck member 18. The at least one pipe 30 may be a pipe for conducting liquefied gas or gas to and/or from the tank 20. At least one of the pipes 30 may be connected to a bunkering station 56 for refilling the tank 20 with liquefied hydrocarbon gas. Other pipes 30 may be arranged for conducting gas and/or liquefied gas to a gas consuming unit in the floating vessel 2.

The upper side 22 of the deck member 18 adjacent to the tank 20 is contiguous with an ambient environment of the floating vessel 2. The space around the top 26 of the tank 20 is open towards a sea side of the platform 4, i.e. a portion of the deck member 18 forms a balcony. In this manner the top 26 of the tank 20 is naturally ventilated. Moreover, also the bunkering station 56 arranged on the balcony is naturally ventilated.

The deck member 18 forms a lower deck, above which lower deck one or more higher level decks extend. Thus, the space around the top 26 of the tank 20 is laterally open towards a sea side of the platform 4. In alternative embodiments it is foreseen that at least one further lower deck extends below the deck member 18.

The floating vessel 2 is a semi-submersible offshore platform 4 comprising one or more submersible pontoons 6, at least two columns 8 (one of which is shown). The semi-submersible offshore platform 4 further comprises a deck structure 14 adapted to be arranged above a water surface. In these embodiments, the deck structure 14 comprises the deck member 18 which forms a lower deck, a tween deck 58, and a main deck 60. Depending on the type of platform, various devices and forms of equipment may be arranged on the main deck 60.

The floating vessel 2 comprises a tunnel 40 extending through the deck structure 14. The tunnel 40 is arranged in open connection to an ambient environment of the floating vessel 2. In these embodiments the tunnel 40 connects to the ambient environment of the floating vessel 2 via the space comprising the top 26 of the tank 20 and the bunkering station 56. Pipes leading to and/or from the tank 20, and/or a further tank, and/or a gas consuming unit aboard the floating vessel 2 extend through the tunnel 40. For instance a liquefied gas pipe 62 may extend from the bunkering station 56 to the further tank via the tunnel 40. In this manner both the tank 20 and the further tank may be filled from the same side of the floating vessel 2. Thus, a ship carrying liquefied hydrocarbon gas may fill both tanks only boarding one side of the floating vessel 2.

An inclined plate member 64 is arranged beneath the pipes 30, 62 in the space comprising the top 26 of the tank 20 and the bunkering station 56. The inclined plate member 64 is inclined downwardly to outside the floating vessel 2. Thus, should a pipe 30, 62 or a connection to the tank 20 or the bunkering station 56 rupture, liquefied gas will be conducted via the inclined plate member 64 to outside the floating vessel 2 instead of damaging the floating vessel 2. The inclined plate member 64 may connect to an inclined surface inside the tunnel 40.

Figure 4:
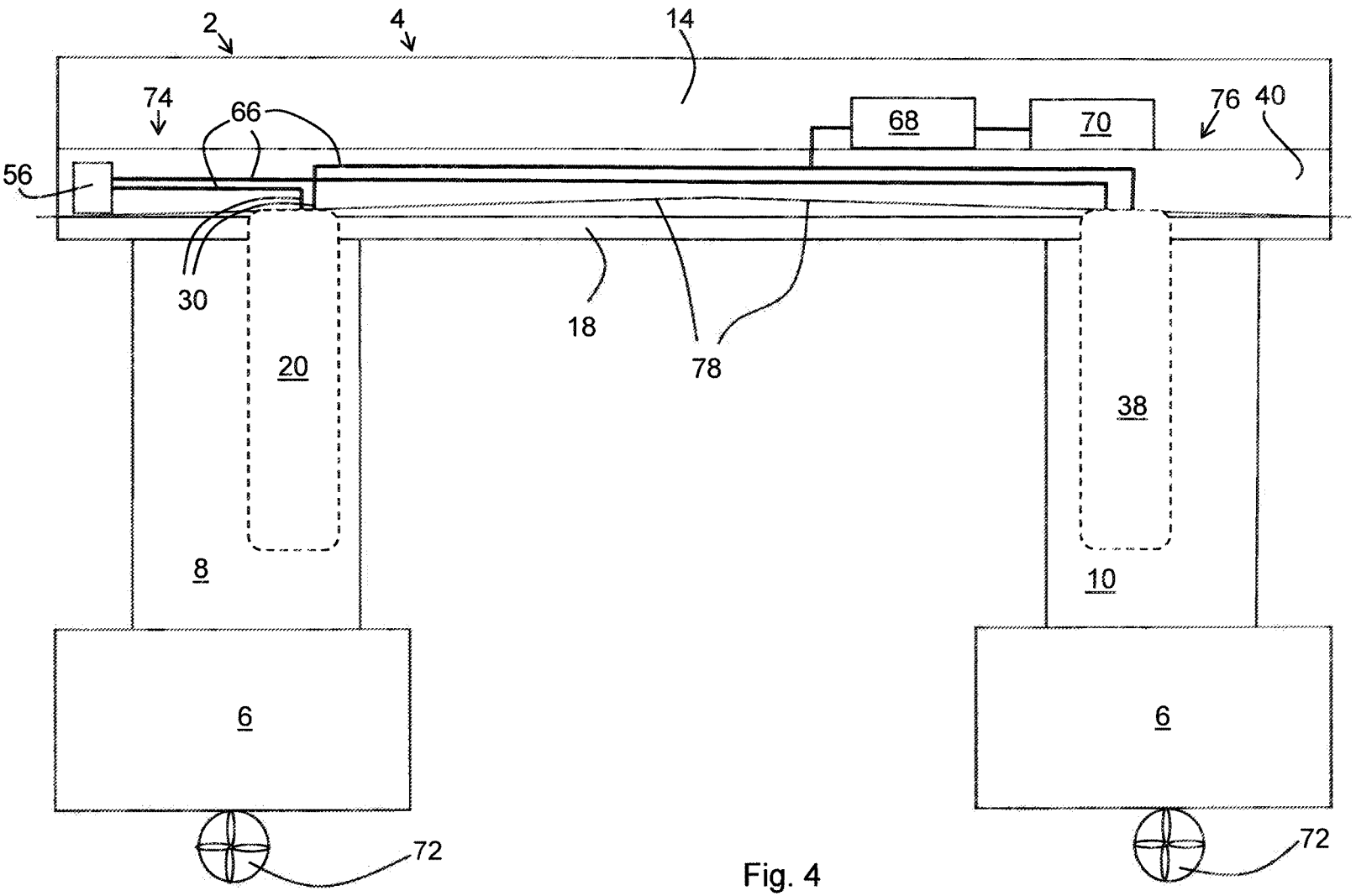

FIG. 4 schematically illustrates a front view cross section of embodiments of a floating vessel 2 in the form of a semi-submersible offshore platform 4. The semi-submersible offshore platform 4 comprises two submersible pontoons 6, a first column 8, a second column 10, and further columns, not shown. The semi-submersible offshore platform for may comprise up to eight columns. The semi-submersible offshore platform 4 further comprises a deck structure 14 adapted to be arranged above a water surface. The columns 8, 10 are connected to the one two submersible pontoons 6. The deck structure 14 comprises a deck member 18.

The semi-submersible offshore platform 4 comprises a tank 20 for liquefied hydrocarbon gas. The tank 20 extends through the deck member 18. The tank 20 is supported by the deck member 18. Again, the tank 20 may be suspended at less than ⅓ of a total height of the tank 20, seen from the top of the tank 20.

At least one pipe 30 is connected to the tank 20 above the upper side 22 of the deck member 18. The at least one pipe 30 may be a pipe for conducting liquefied gas or gas to, and/or from, the tank 20.

The tank 20 is arranged in the first column 8. The floating vessel 2 comprises a further tank 38 for liquefied gas. The further tank 38 is arranged in the second column 10. The floating vessel 2 comprises a tunnel 40 extending through the deck structure 14. The tunnel 40 is arranged in open connection to an ambient environment of the semi-submersible offshore platform 4. Pipes 66 leading to and/or from the tank 20 and the further tank 38 extend through the tunnel 40. Thus, the pipes 66 for liquefied gas or gas are arranged in a ventilated environment.

The semi-submersible offshore platform 4 comprises an engine 68 and/or other gas consumer 70. The tank 20 may be a dedicated fuel tank for the engine 68 and/or other gas consumer 70. The engine 68 may be an engine for directly or indirectly propelling the floating vessel and/or an engine for driving an electric generator. The semi-submersible offshore platform 4 may comprise electrically powered thrusters 72. Such thrusters 72 may be used for maintaining a stable platform position if the semi-submersible offshore platform 4 is not anchored to the bottom of the sea and/or for propelling the semi-submersible offshore platform 4.

At least one pipe 66 leading from the tank 20 and/or the further tank 38 to the engine 68 and/or the other gas consumer 70 extends through the tunnel 40.

As illustrated in FIG. 4, from a first end portion 74 of the tunnel 40, pipes 66 lead to and/or from the tank 20 and the further tank 38, as well as from the tank 20 to the engine 68 and/or other gas consumer 70. Also illustrated is a bunkering station 56 arranged in vicinity of the first end portion 74 of the tunnel 40. Suitably, a similar arrangement is provided at a second end portion 76 of the tunnel 40. For the sake of clarity this arrangement has not been illustrated in FIG. 4. The arrangement comprises pipes leading from the second end portion 76 to and/or from the further tank 38 and the tank 20, as well as from the further tank 38 to the engine 68 and/or other gas consumer 70. Suitably, a further bunkering station is arranged in vicinity of the second end portion 76 of the tunnel 40. In this manner both the tank 20 and the further tank 38 may be filled from the same side of the floating vessel 2. Thus, a ship carrying liquefied hydrocarbon gas may fill both tanks 20, 38 by only having to board one side of the semi-submersible offshore platform 4, preferably a leeward side.

The tunnel 40 comprises an inclined surface 78 arranged beneath the pipes 66 in the tunnel 40. The inclined surface 78 is inclined downwardly towards an end of tunnel 40. In these embodiments, the inclined surface 78 has been illustrated inclined downwardly towards both ends of the tunnel 40. The inclined surface 78 is inclined downwardly to outside the semi-submersible offshore platform 4. Thus, should a pipe 30, 66 rupture, liquefied gas will be conducted via the inclined surface 78 to outside the floating vessel 2 instead of damaging the floating vessel 2.

This invention should not be construed as limited to the embodiments set forth herein. A person skilled in the art will realize that different features of the described embodiments may be combined to create embodiments other than those described herein, without departing from the scope of protection, as defined by the appended claims. Although the description refers to example embodiments, many different alterations, modifications and the like will become apparent for those skilled in the art. For instance, illustrated embodiment of the tunnel 40 have a substantially straight extension through the deck structure 4. Alternatively, the tunnel 40 may have a curved or other nonlinear extension. Accordingly, the tunnel 40 may not only extend between lateral side portions of the floating vessel 2. It is also foreseen that the tunnel 40 connects to upper and lower side portions of the floating vessel, or a lateral side portion and an upper or a lower side portion of the floating vessel. An opening in a lower side portion may for instance be provided in a deck structure of a semi-submersible offshore platform.

Therefore, it is to be understood that the foregoing is illustrative of various example embodiments and that the scope of protection is defined only by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A floating vessel comprising:

a deck member, wherein during use of the floating vessel, the deck member comprises an upper side facing upwardly and a lower side facing downwardly;

a tank for liquefied hydrocarbon gas that comprises: a top and a bottom, wherein the tank extends through the deck member and wherein the tank is supported by the deck member suspended at less than ⅓ of a total height of the tank from the top of the tank;

at least one pipe connected to the tank above the upper side of the deck member; and an inclined plate member arranged between the at least one pipe and the upper side of the deck member, wherein only a portion of the inclined plate member is positioned above the top of the tank and in a space between the at least one pipe and the top of the tank.

2. The floating vessel according to claim 1, wherein the upper side of the deck member adjacent to the tank is contiguous with an ambient environment of the floating vessel.

3. The floating vessel according to claim 1, comprising a dedicated tank compartment for the tank underneath the deck member.

4. The floating vessel according to claim 3, comprising a guide arrangement arranged between the compartment and a bottom end portion of tank.

5. The floating vessel according to claim 1, wherein the tank comprises at least one projection, the at least one projection being arranged to transfer a weight of the tank to the deck member.

6. The floating vessel according to claim 1, comprising a seal arranged between the tank and the upper side of the deck member.

7. The floating vessel according to claim 1, wherein the tank comprises at least one protuberance extending underneath the deck member.

8. The floating vessel according to claim 1, wherein the tank comprises a self-supporting tank structure.

9. The floating vessel according to claim 1, wherein the tank is elongated and has a longitudinal axis, and wherein the longitudinal axis is arranged substantially vertically in the floating vessel.

10. The floating vessel according to claim 1, comprising an engine and/or another gas consumer, wherein the tank is a dedicated fuel tank for the engine and/or the other gas consumer.

11. The floating vessel according to claim 1, wherein the floating vessel is a semi-submersible offshore platform comprising one or more submersible pontoons, at least a first and a second column, and a deck structure adapted to be arranged above a water surface and comprising the deck member, and wherein the first and second columns are connected to the one or more submersible pontoons and the deck structure.

12. The floating vessel according to claim 1, further comprising a dedicated tank compartment for the tank underneath the deck member, wherein the first column comprises at least a first portion and a second portion, the first portion being arranged closer to the second column than the second portion, and wherein the compartment is arranged in the first portion.

13. The floating vessel according to claim 1, comprising a tunnel extending through the deck structure, wherein the tunnel is arranged in open connection to an ambient environment of the floating vessel, and wherein pipes leading to and/or from the tank and the further tank extend through the tunnel.

14. The floating vessel according to claim 13, further comprising an engine and/or an other gas consumer, wherein the tank is a dedicated fuel tank for the engine and/or the other gas consumer, wherein a pipe leading from the tank to the engine and/or the other gas consumer extends through the tunnel.

15. The floating vessel according to claim 13, wherein the tunnel comprises an inclined surface at least partially defining the tunnel arranged beneath the pipes in the tunnel, the inclined surface being inclined downwardly towards an end of the tunnel.

16. The floating vessel according to claim 1, wherein the inclined plate member is inclined downwardly to outside the floating vessel.

17. The floating vessel according to claim 15, wherein the inclined plate member is connected to the inclined surface inside the tunnel.

18. A system for conveying liquefied hydrocarbon gas, comprising a floating vessel;

a deck member disposed on the floating vessel, a tank for liquefied hydrocarbon gas, the tank including:

a top and a bottom, wherein the tank extends through the deck member and wherein the tank is supported by the deck member;

at least one pipe connected to the tank at a location above the deck member; and an inclined plate member positioned between the at least one pipe and the deck member, wherein the inclined plate member has a first portion above the top of the tank and a second portion below the top of the tank.

19. The system of claim 18, wherein the inclined plate member extends across at least a portion of the top of the tank.

20. The system of claim 18, further comprising an upper deck member disposed on the floating vessel, wherein a tunnel is formed between the upper deck member and the lower deck member disposed on the floating vessel, and wherein the least one pipe is positioned in the tunnel.

* * * * *